US008874329B2

(12) United States Patent
Zinke

(10) Patent No.: US 8,874,329 B2
(45) Date of Patent: Oct. 28, 2014

(54) METHOD AND DEVICE FOR MONITORING THE STABILITY OF A LOADING CRANE MOUNTED ON A VEHICLE

(71) Applicant: Palfinger AG, Salzburg (AT)

(72) Inventor: Thomas Zinke, Dresden (DE)

(73) Assignee: Palfinger AG, Salzburg (AT)

( * ) Notice: Subject to any disclaimer, the term of this patent is extended or adjusted under 35 U.S.C. 154(b) by 0 days.

(21) Appl. No.: 14/047,388

(22) Filed: Oct. 7, 2013

(65) Prior Publication Data

US 2014/0032060 A1 Jan. 30, 2014

Related U.S. Application Data

(63) Continuation of application No. PCT/AT2012/000092, filed on Apr. 5, 2012.

(30) Foreign Application Priority Data

Apr. 8, 2011 (AT) ..... A 500/2011

(51) Int. Cl.
*B66C 23/90* (2006.01)
*B66C 23/78* (2006.01)

(52) U.S. Cl.
CPC ..... *B66C 23/905* (2013.01); *B66C 23/78* (2013.01)
USPC ..... 701/50; 340/440; 340/685; 212/277

(58) Field of Classification Search
None
See application file for complete search history.

(56) References Cited

U.S. PATENT DOCUMENTS

| | | | | |
|---|---|---|---|---|
| 5,527,060 | A * | 6/1996 | Kutsche | 280/5.515 |
| 5,887,735 | A * | 3/1999 | Abel | 212/277 |
| 6,424,907 | B1 * | 7/2002 | Rieth et al. | 701/124 |
| 2002/0002431 | A1 * | 1/2002 | Panizzolo | 701/37 |
| 2007/0083312 | A1 | 4/2007 | Lehnen | |
| 2007/0090612 | A1 | 4/2007 | Gelies | |

FOREIGN PATENT DOCUMENTS

| | | |
|---|---|---|
| DE | 103 49 234 | 5/2005 |
| EP | 0 864 473 | 9/1998 |
| EP | 1 757 739 | 2/2007 |
| EP | 2 298 689 | 3/2011 |

OTHER PUBLICATIONS

International Search Report (ISR) issued Jul. 31, 2012 in International (PCT) Application No. PCT/AT2012/000092.
Austrian Patent Office Search Report (ASR) completed Jan. 27, 2012 in Austrian Patent Application No. A 500/2011.

* cited by examiner

*Primary Examiner* — John R Olszewski
*Assistant Examiner* — Gerrad A Foster
(74) *Attorney, Agent, or Firm* — Wenderoth, Lind & Ponack, L.L.P.

(57) ABSTRACT

A method for monitoring a stability parameter of a loading crane mounted on a vehicle supported on the ground by wheels and by support elements separate from the wheels includes calculating, using a processor, the stability parameter of the loading crane mounted on the vehicle supported on the ground by the wheels and the support elements, and comparing the magnitude of the stability parameter to at least one predetermined limit value. The calculating includes detecting contributions to a magnitude of the stability parameter of the wheels of the vehicle on which the loading crane is mounted and detecting contributions to the magnitude of the stability parameter of the support elements of the vehicle on which the loading crane is mounted.

27 Claims, 4 Drawing Sheets

METHOD AND DEVICE FOR MONITORING THE STABILITY OF A LOADING CRANE MOUNTED ON A VEHICLE

BACKGROUND OF THE INVENTION (1) Field of the Invention

The invention concerns a method and a device for monitoring at least one stability parameter of a loading crane mounted on a vehicle, wherein during crane operation the vehicle is or can be supported on the ground by means of wheels and by means of support elements separate from the wheels.

(2) Description of Related Art

Usually the support elements are support legs which can be extended in a vertical direction and which are mounted to a support extension which can be laterally extended in a horizontal direction. In that case the property of extendibility of the support legs and of the support extension is afforded by a telescopic structure. The vehicles which are relevant in connection with the invention generally have one or two such support extensions each having two support legs.

In accordance with standard EN 12999 an overload safety device for loading cranes with carrying capacities of over 1000 kg is required. In accordance with that standard the corresponding stability check is performed with a test load corresponding to 125% of the specified carrying capacity. What is important is that in that case at least one wheel which is braked by means of a parking brake (generally manually actuated) must remain on the ground. In that case the loading crane is in a so-called partially lifted condition. The at least one wheel which is braked by means of a parking brake and which must remain on the ground functions as an additional friction location and serves to carry horizontal forces.

It is known that the load moment limitation for the overload safety means in accordance with EN 12999 is resolved by means of lifting force adaptations in the crane hydraulic system. For crane operations with support elements which are not completely extended laterally and/or with boom positions beyond the driving cab additional lifting force limitations have to be implemented. Performance graph-based lifting force adaptations are part of the state of the art.

The high level of adjusting and checking complication and expenditure however is deemed a disadvantage in the case of such system solutions. There is the risk of maladjustments. In addition, no working loads are taken into account. To avoid those disadvantages preferably effects of crane operation on the overall machine are to be detected by a sensor system.

For truck-mounted concrete pumps there are approaches to such solutions, which point in that direction. By way of example DE 103 49 234 A1 is to be mentioned in this connection. Here, for monitoring stability, the support forces in the support legs are determined and calculated to give a stability index. It will be noted however that during operation thereof truck-mounted concrete pumps are in the fully lifted condition, that is to say, none of their wheels are resting on the ground. The solutions used for truck-mounted concrete pumps are therefore not suitable for the loading cranes which are relevant in connection with the present invention and which must comply with EN 12999.

Further approaches in regard to monitoring stability of a crane mounted on a vehicle are known from EP 2 298 689 A2, EP 1 757 739 A2 and EP 0 864 473 A2. None of those approaches can satisfy EN 12999.

SUMMARY OF THE INVENTION

Therefore the object of the invention is to avoid the above-described disadvantages and to provide a solution, improved over the state of the art, for stability monitoring of a loading crane mounted on a vehicle.

According to the invention that object is attained by the features described herein.

One of the basic ideas of the invention is therefore that it is not just the contributions of the support elements but also the contributions of the wheels to the magnitude of at least one stability parameter, that are detected, said magnitude being compared to at least one predetermined limit value.

Advantageously in that respect—depending on whether the at least one predetermined limit value involves an upper or a lower critical limit—at least one warning signal is outputted (to the operator of the crane) and/or at least one measure for returning to compliance with the limit value is implemented, when the magnitude exceeds or falls below the limit value. They include in particular correction movements of the boom system.

As the stability which can be achieved by the support elements that are usually employed is not of equal magnitude in every partial region of the theoretically conceivable operating space of the boom system and as the support elements cannot be completely extended under certain operating conditions, for example on constricted building sites, it is further advantageous if a rotational angle $\alpha$ of the loading crane about a vertical axis and/or an extension condition of the support elements is detected. In that case it is possible for the at least one stability parameter to be monitored in dependence on the rotational angle $\alpha$ and/or the extension condition of the support elements. The relative position of the support elements in relation to the vehicle is known by virtue of detection of the extension condition of the support elements. If—as described above—the support elements are support legs which can be extended in a vertical direction and which are mounted to a support extension which is laterally extendable in a horizontal direction, then detection of the extension condition of the support elements includes both detection of the distance by which the support extension is extended and also detection of the distances by which the support legs are extended.

In preferred embodiments the number a of the wheels and support elements, by means of which the vehicle is supported on the ground, and/or the force-stability coefficient $S_F$ is monitored as the stability parameter, wherein $S_F$ is calculated from the support forces $F_i$ provided by means of the wheels and the support elements. In that respect the calculation of $S_F$ is preferably effected in accordance with the following formula:

$$S_F = \frac{\sum_{i=1}^{a_{total}} F_i}{\sum_{i=1}^{a_{min}-1} F_{i,max}}$$

wherein $a_{total}$ specifies a total number of the wheels and support elements, $a_{min}$ specifies a predetermined minimum number of wheels and support elements, by means of which the vehicle must be supported at least on the ground, and $F_{i,max}$ specifies the $(a_{min}-1)$ greatest support forces. $S_F$ is a dimension-less value which has the following effect: on the assumption that the vehicle can be supported on the ground by means of two front wheels and two rear wheels and a laterally extendable support extension having two support elements, that is to say the following would apply: $a_{total}=6$. If it is further to be assumed that a labile condition in which the vehicle threatens to tip over occurs when the vehicle is only still standing on a front wheel and a rear wheel as well as a support element, wherein the front and rear wheels and the support element are on the same side of the vehicle, it would be necessary to require that, in the operative condition, at no time does the magnitude fall below the limit value $a_{min}=4$, in order not to reach that labile condition. The advantage of the force-stability coefficient $S_F$ is now that it is possible to monitor compliance with that predetermined limit value very easily by means thereof, by paying attention that the value of $S_F$—calculated in accordance with the foregoing formula—is always greater than 1. In the case of the labile condition, that is to say in the case of only three support points, then more specifically the total of forces in the denominator would assume the same value as the total of forces in the numerator, as then the three greatest support forces are the three sole support forces which are different from zero.

In the situation where the vehicle can be supported on the ground by means of two front wheels and two rear wheels, in particular being in the form of twin wheels, as well as two laterally extendable support extensions each having two support elements, and the rotational angle $\alpha$ of the loading crane about a vertical axis and the extension condition of the support elements is detected, it is advantageous if with laterally fully extended support extensions, depending on the respective rotational angle of the loading crane $a_{min}=6$ or $a_{min}=5$, and with laterally not fully extended support extensions $a_{min}=6$.

In the situation where the vehicle can be supported on the ground by means of two front wheels and two rear wheels which in particular are in the form of twin wheels, and a laterally extendable support extension having two support elements, and the rotational angle of the loading crane about a vertical axis and the extension condition of the support elements is detected, it is advantageous if with the laterally fully extended support extension, depending on the respective rotational angle of the loading crane $a_{min}=6$ or $a_{min}=4$, and with laterally not fully extended support extensions $a_{min}=6$.

It should be noted that the above-mentioned standard EN 12999 is also automatically met by compliance with the limit values for $a_{min}$, referred to in the last two paragraphs, assuming that all wheels can be braked by a parking brake.

If the support forces $F_i$ provided by means of the wheels are detected, it is appropriate in the course of stability monitoring, to also additionally monitor the axle loads as they can be very easily calculated from the corresponding support forces $F_i$ (by totaling). The axle load is the proportion of the total mass (inherent mass and mass of the load on a vehicle) which occurs on an axle (a wheel set) of that vehicle.

It is particularly advantageous for the support forces $F_i$ provided by means of the wheels to be detected by means of a measurement of spring relief travel (of the wheel spring assemblies). For that purpose it is advantageous, for each of the wheels, to detect once a spring relief characteristic (spring relief travel in dependence on the support force). Those characteristic curves can then be used at any time for conversion of the measured spring relief travels into support forces. The maximum possible spring relief travel corresponds to the travel at which a wheel lifts off the ground and the support force provided by that wheel assumes the value of zero. That procedure is appropriate in particular in relation to vehicles which have leaf spring assemblies with a linear spring characteristic. With other kinds of spring arrangements, it would be possible for example for the sake of simplicity also to convert the measured lengths $L_i$ of the vibration dampers of the wheels directly into a length-stability coefficient $S_L$, and to monitor the value of $S_L$. In that respect the calculation of $S_L$ is preferably effected in accordance with the following formula:

$$S_L = \frac{\sum_{i=1}^{r_{total}} L_{rem,i}}{\sum_{i=1}^{r_{min}-1} L_{rem,i,max}},$$

with $$L_{rem,i} = L_{limit,i} - L_i,$$

wherein $r_{total}$ specifies a total number of the wheels, $r_{min}$ specifies a predetermined minimum number of wheels, by means of which the vehicle must be supported at least on the ground, $L_{rem,i}$ specify remaining lengths of the vibration dampers until the wheels lift off, $L_{limit,i}$ specifies limit lengths of the vibration dampers, at which the wheels lift off the ground, and $L_{rem,i,max}$ specifies the $(r_{min}-1)$ greatest remaining lengths of the vibration dampers. As in the case of the force-stability coefficient $S_F$ it would then be possible in the course of stability monitoring to ensure that the value of $S_L$ is always greater than 1.

A further advantageous embodiment provides that the extension condition of the support elements is detected, and, based thereon, the possible tipping lines $K_j$ of the vehicle are calculated during crane operation. If in addition the distances $l_{i,Kj}$ of the wheels and support elements relative to the tipping lines $K_j$ are calculated and if at the same time the rotational angle $\alpha$ of the loading crane about a vertical axis and the support forces F, provided by means of the wheels and the support elements are detected, it is possible to monitor the remaining stability moment $M_{rem,K\alpha}$ in dependence on the rotational angle $\alpha$ of the loading crane in relation to the current relevant tipping line $K_\alpha$ as the stability parameter, wherein $M_{rem,K\alpha}$ is calculated in accordance with the following formula:

$$M_{rem,K\alpha} = \sum_{i=1}^{a_{total}} F_i \cdot l_{iK\alpha},$$

wherein $a_{total}$ specifies the total number of wheels and support elements.

Protection is also claimed for a device for monitoring at least one stability parameter of a loading crane mounted on a vehicle, wherein during crane operation the vehicle is supported on the ground by means of wheels and by means of support elements separate from the wheels, characterised in that the device has:

- wheel and support element measuring devices, by which both contributions of the wheels and also contributions of the support elements to the magnitude of the at least one stability parameter can be detected, and
- a control and regulating unit, to which measuring signals of the wheel and support element measuring devices can be fed, wherein a magnitude of the at least one stability parameter can be detected by the control and regulating unit and can be compared to at least one predetermined limit value.

Once again—just as described in connection with the method according to the invention—the at least one stability parameter can involve the number a of the wheels and support elements, by means of which the vehicle is supported on the ground, and/or the force-stability coefficient $S_F$ and/or the remaining stability moment $M_{rem,K\alpha}$ in dependence on the rotational angle $\alpha$ of the loading crane in relation to the current relevant tipping line $K_\alpha$.

Advantageously when the magnitude exceeds or falls below the at least one predetermined limit value at least one warning signal can be generated and/or at least one measure for returning to compliance of the at least one predetermined limit value is controllable by the control and regulating unit. The warning signal can be generated by the control and regulating unit for example in the form of an electric pulse sequence and then converted into an optical and/or acoustic signal by means of warning lights and/or loudspeakers. The at least measure for restoring compliance with the at least one predetermined limit value can be stored for example as a programmed handling procedure in the control and regulating unit. In the simplest case the handling procedure is a stop process, by which crane operation is stopped.

It is further advantageous if the apparatus has a rotational angle measuring device for detecting a rotational angle $\alpha$ of the loading crane about a vertical axis and/or an extension condition measuring device for detecting an extension condition of the support elements, wherein the measuring signals of the rotational angle and/or extension condition measuring device can be fed to the control and regulating unit (for example by means of suitable signal lines or by wireless communication). In the situation where the support elements are support legs mounted to a laterally extendable support extension and that all non-variable parameters (like for example the mounting position of the support extension on the vehicle chassis frame) are known and stored in the control and regulating unit, to determine the position of the support elements relative to the vehicle it is only still necessary to detect the extension lengths of the support extension and of the support legs by means of the extension condition measuring device.

For the situation where the support elements are arranged on at least one laterally extendable support extension and the loading crane rests on a crane base connected to the at least one support extension, it is advantageous if the support element measuring devices are arranged in the support elements and/or at the connection of the support elements to the support extension and/or at the connection of the support extension to the crane base.

In a preferred embodiment the support forces $F_i$ provided by means of the wheels and the support elements can be detected by the wheel and support element measuring devices. In the case of the support forces $F_i$ afforded by the support elements, that is possible for example by the support element measuring devices being in the form of force measuring cells. In the case of the wheels, measurement of the support forces $F_i$ can be effected for example by way of a measurement of spring relief travels (of the wheel spring assemblies) or the lengths $L_i$ of the vibration dampers (for example by means of cable-actuated length sensors) or by way of a measurement of the internal tire pressures. It is also conceivable for wheel force measurement to be implemented by means of strain gauges near the axle ends. If the support forces $F_i$ provided by means of the wheels are detected, it is appropriate (as already described hereinbefore) to also additionally monitor the axle loads in the course of stability monitoring—by means of the control and regulating unit—as they can be very easily calculated from the corresponding support forces (by totaling).

Further embodiments are distinguished in that (with a known position for the support elements relative to the vehicle) the tipping lines $K_j$ of the vehicle during crane operation and in addition the distances $l_{i,Kj}$ of the wheels and support elements relative to the tilt edges $K_j$ can be calculated by the control and regulating unit. On that presumption more specifically (as described hereinbefore) the remaining stability moment $M_{rem,K\alpha}$ can then be monitored subsequently as the stability parameter.

BRIEF DESCRIPTION OF THE DRAWINGS

Further details and advantages of the present invention are described more fully by means of the specific description with reference to the embodiments by way of example illustrated in the drawings in which.

DETAILED DESCRIPTION OF EMBODIMENTS OF THE INVENTION

Figure 1:
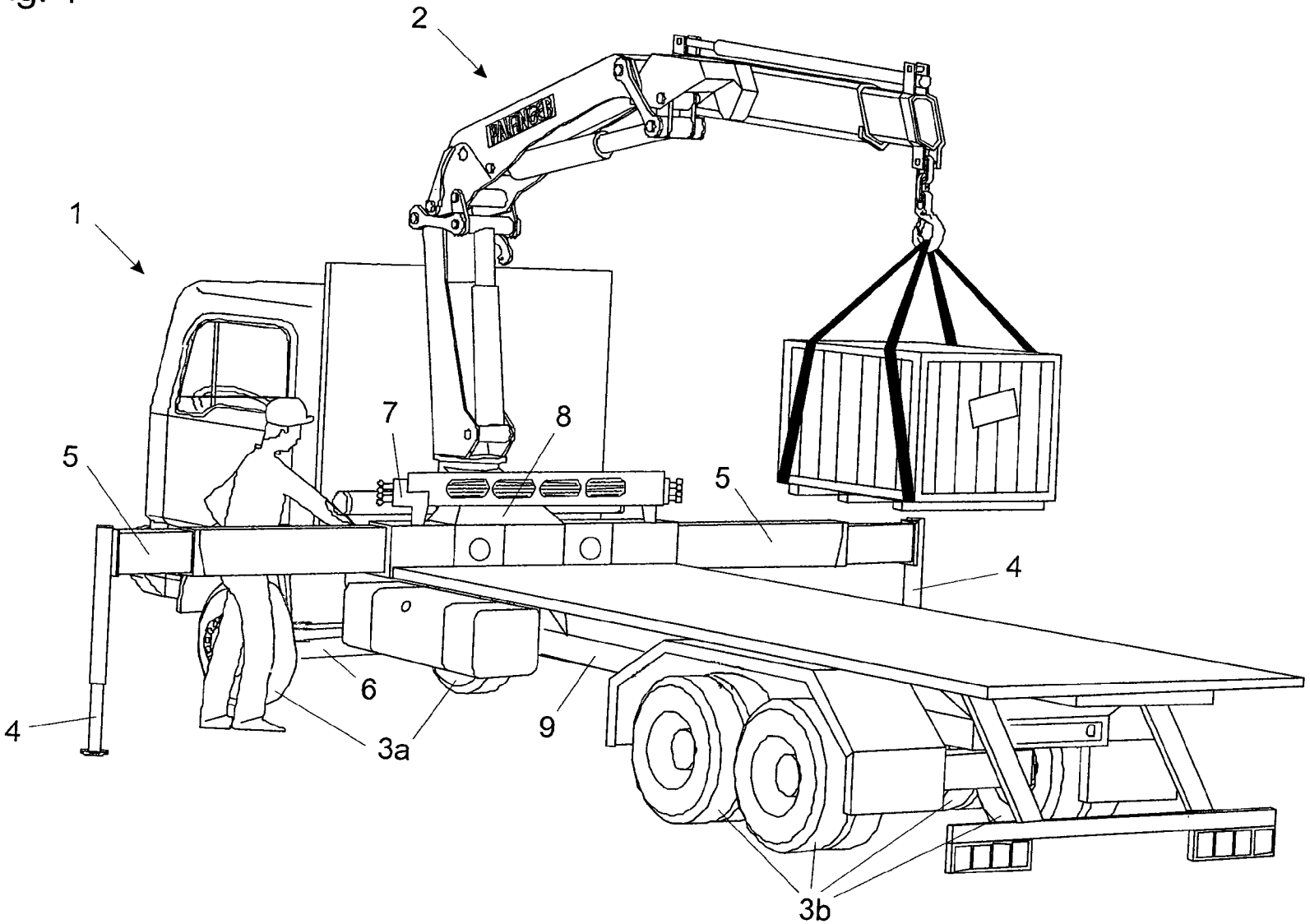
FIG. 1 shows a diagrammatic view of an embodiment of a vehicle on which a loading crane is mounted and which is relevant to the present invention.

FIG. 1 diagrammatically shows one of the examples for a vehicle 1, on which a loading crane 2 is mounted and the stability of which can be monitored by means of the method and the device according to the invention. In this case the vehicle 1 can be supported on the ground by means of two front wheels 3*a* and four rear wheels 3*b* in the form of twin wheels, as well as a laterally extendable support extension 5 having two support elements 4. It is also possible to see one of the axles 6 of the vehicle, a part of the vehicle chassis 9, a control and regulating unit 7 and the crane base 8 of the loading crane 2. The Figure does not show the wheel, support element, rotational angle and extension condition measuring devices as they are partially integrated into given constituent parts of the vehicle—like for example in the case of the support element measuring devices into the support feet 4—or are concealed by other parts of the vehicle.

Figure 2:
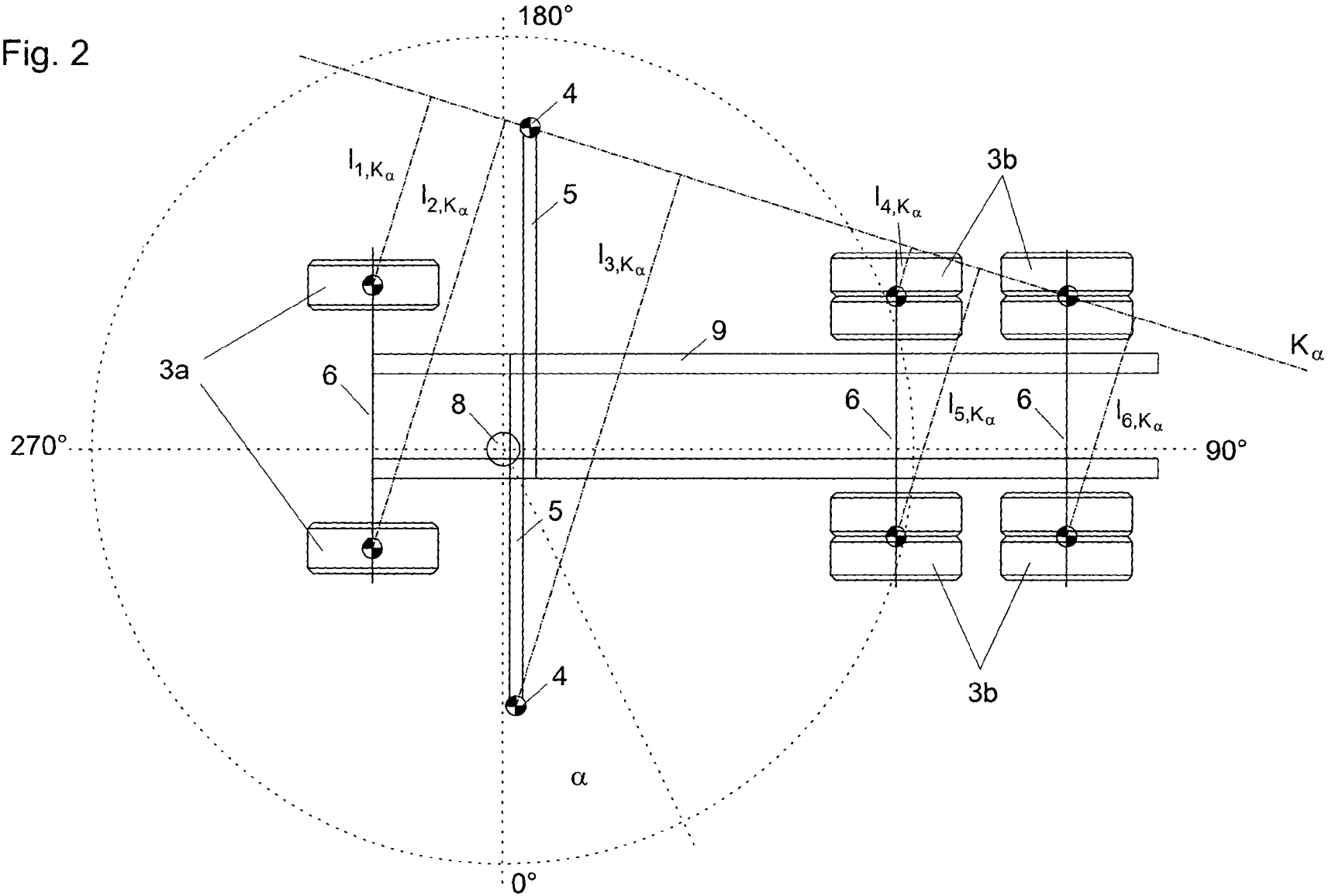
FIG. 2 shows a model of the vehicle shown in FIG. 1, illustrating some of the parameters relevant in terms of stability monitoring.
Figure 4A:
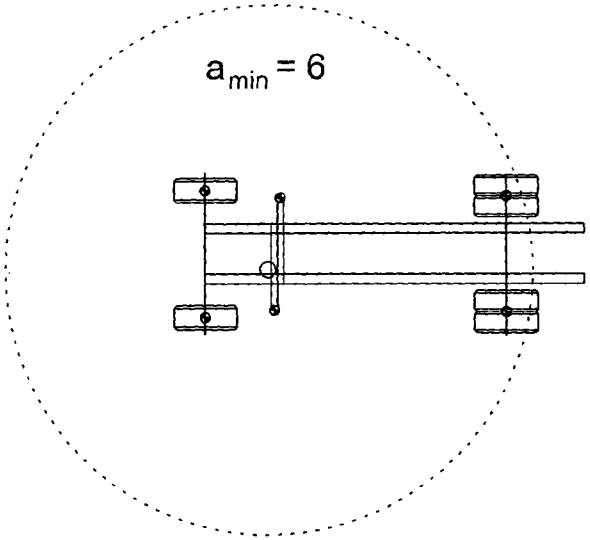
FIGS. 3*a*, 3*b*, 4*a* and 4*b* show limit value illustrations for the minimum number of wheels and support elements, by means of which the vehicle in different embodiments must be supported at least on the ground, in dependence on the rotational angle $\alpha$ of the loading crane and the extension condition of the support elements.
Figure 4B:
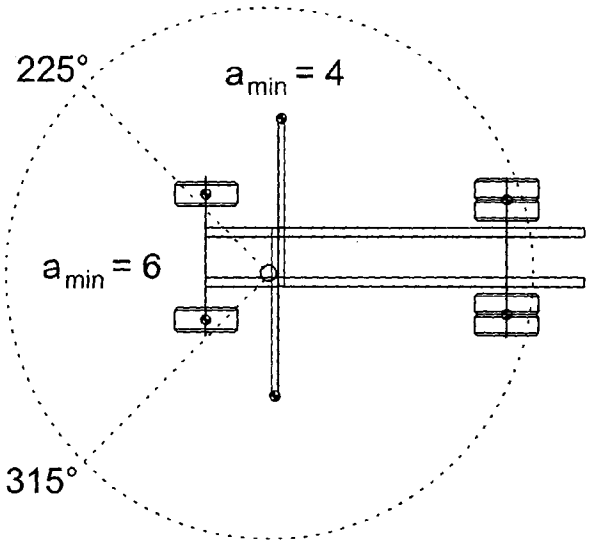

FIG. 2 shows a plan view of a model of the vehicle 1 shown in FIG. 1. This model shows the support points on the ground (black-white circles), the position of the crane base 8 which at the same time also defines the point of intersection of the vertical axis, around which the loading crane 2 can be rotated, with the horizontal plane of the vehicle, one of the tipping lines $K_\alpha$ which are possible in that condition, and the distances $l_{i,K\alpha}$ of the support points (wheels 3*a* and 3*b* and support elements 4) relative to the tipping lines $K_\alpha$. The model further includes a definition of the rotational angle $\alpha$ of the loading crane 2 about the vertical axis. It should be noted that the wheels 3*a* and 3*b* are in reality naturally not support points but support surfaces. As a first approximation however they can be assumed here to be support points.

Figure 3A:
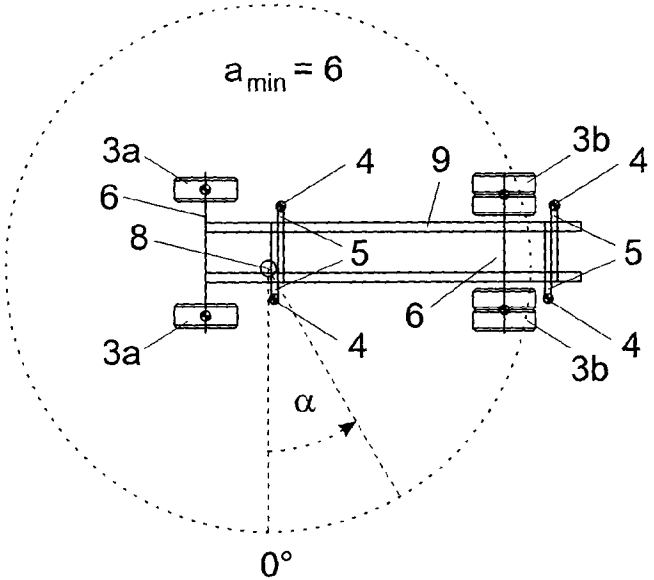
Figure 3B:
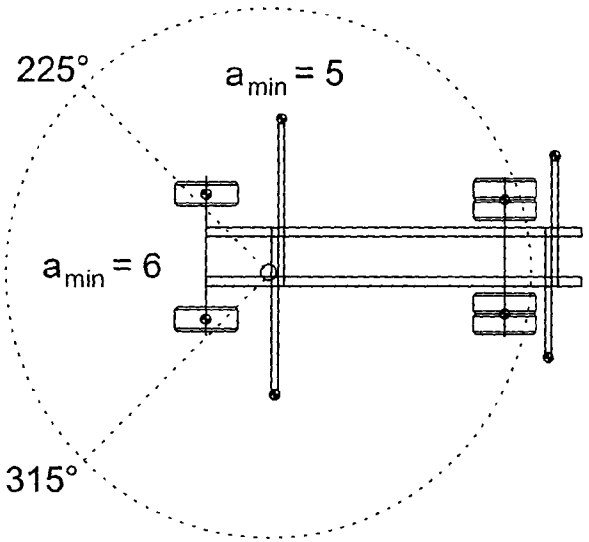

FIGS. 3*a*, 3*b*, 4*a* and 4*b* show preferred limit values for the minimum number of wheels 3*a* and 3*b* and support elements 4, by means of which the vehicle 1, in different embodiments, has to be supported at least on the ground, in dependence on the rotational angle α of the loading crane 2 and the extension condition of the support elements 4. The references are given representatively of that group of Figures, only in FIG. 3*a*. FIGS. 3*a* and 3*b* relate to the situation where the vehicle 1 can be supported on the ground at a maximum by means of two front wheels 3*a* and two rear wheels 3*b* in the form of twin wheels, as well as two laterally extendable support extensions 5 each having two support elements 4. In this case it is advantageous if, with the laterally fully extended support extensions 5 (FIG. 3*b*), with a rotational angle α of the loading crane 2 of between about 225° and 315°, $a_{min}$=6 or $a_{min}$=5 while with the support extensions 5 not being fully laterally extended (FIG. 3*a*) $a_{min}$=6 is always selected to ensure stability of the vehicle 1 in the crane operation. If in contrast the vehicle has only one laterally extendable support extension 5 having two support elements 4, it is then advantageous, with laterally fully extended support extensions 5 (FIG. 4*b*), with a rotational angle α of the loading crane 2 of between about 225° and 315°, for $a_{min}$=6 or $a_{min}$=4, and with the support extensions 5 not fully laterally extended (FIG. 4*a*), for $a_{min}$=6.

Figure 5:
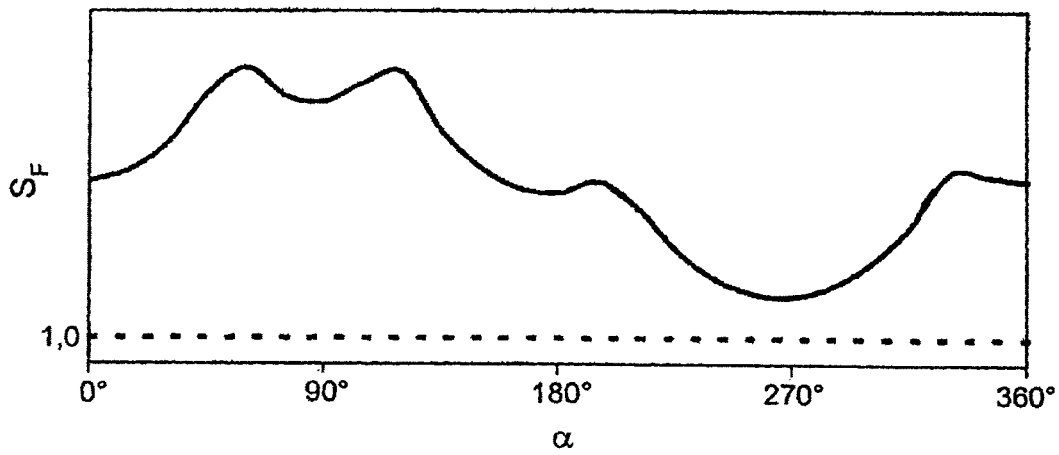
FIG. 5 shows an exemplary characteristics of the force-stability coefficient $S_F$ in dependence on the rotational angle $\alpha$ of the loading crane.

FIG. 5 shows an exemplary characteristics of the force-stability coefficient $S_F$ in dependence on the rotational angle α of the loading crane. That configuration is involved for example in the situation shown in FIG. 3*b*. It can be very clearly seen that the value of $S_F$ assumes an absolute minimum at between about 225° and 315°. Here the loading crane 2 or the boom system is over the driving cab. To ensure stability it is therefore advantageous to require $a_{min}$=6 for that angular range.

Figure 6:
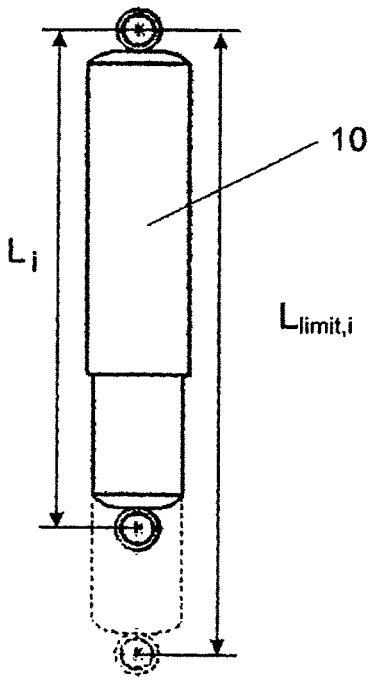
FIG. 6 shows a diagrammatic view of a possible vibration damper of a wheel.

FIG. 6 shows a diagrammatic view of a possible vibration damper 10 of one of the wheels 3*a* and 3*b*. The drawing shows in broken line the position of the damper 10, at which the wheel would lift off the ground. In addition the values $L_i$ and $L_{limit,i}$, which are relevant for calculation of the length-stability coefficient $S_L$ are also shown.

The invention claimed is:

1. A method for monitoring a stability parameter of a loading crane mounted on a vehicle supported on the ground by one or more wheels and by one or more support elements separate from the wheels, wherein there is a predetermined minimum number of wheels and support elements by which the vehicle must be supported, the method comprising:

calculating, using a processor, the stability parameter of the loading crane mounted on the vehicle supported on the ground by the wheels and the support elements, including detecting contributions to a magnitude of the stability parameter of the wheels of the vehicle on which the loading crane is mounted, and detecting contributions to the magnitude of the stability parameter of the support elements of the vehicle on which the loading crane is mounted; and comparing the magnitude of the stability parameter to at least one predetermined limit value.

2. The method of claim 1, further comprising:

outputting a warning signal and/or implementing a measure for return to compliance with at the at least one predetermined limit value when the magnitude exceeds or falls below the at least one predetermined limit value.

3. The method of claim 1, further comprising:

detecting a rotational angle of the loading crane about a vertical axis and/or an extension condition of the support elements.

4. The method of claim 3, wherein the stability parameter is monitored in dependence on the rotational angle of the loading crane and/or the extension condition of the support elements.

5. The method of claim 1, wherein said determining includes monitoring a number of the wheels and the support elements.

6. The method of claim 1, wherein a force-stability coefficient ($S_F$) is monitored as the stability parameter, and wherein the force-stability coefficient ($S_F$) is calculated from support forces ($F_i$) provided by the wheels and the support elements.

7. The method of claim 6, wherein the force stability coefficient ($S_F$) is calculated in accordance with the following formula:

$$S_F = \frac{\sum_{i=1}^{a_{total}} F_i}{\sum_{i=1}^{a_{min}-1} F_{i,max}}$$

wherein ($a_{total}$) specifies a total number of the wheels and support elements, ($a_{min}$) specifies a predetermined minimum number of wheels and support elements by which the vehicle must be supported, and ($F_{i,max}$) specifies ($a_{min}$−1) greatest support forces.

8. The method of claim 7, wherein the vehicle is configured to be supported on the ground by two front wheels and two rear wheels which in particular are in the form of twin wheels, and two laterally extendable support extensions each having two support elements, wherein the rotational angle of the loading crane about a vertical axis and the extension condition of the support elements is detected, wherein with laterally fully extended support extensions $a_{min}$=6 or $a_{min}$=5, depending on the rotational angle of the loading crane, and wherein with laterally not fully extended support extensions $a_{min}$=6.

9. The method of claim 8, wherein the vehicle is configured to be supported on the ground by two front wheels and two rear wheels which in particular are in the form of twin wheels, and a laterally extendable support extension having two support elements, wherein the rotational angle of the loading crane about a vertical axis and the extension condition of the support elements is detected, wherein with laterally fully extended support extensions $a_{min}$=6 or $a_{min}$=4, depending on the rotational angle of the loading crane, and wherein with laterally not fully extended support extensions $a_{min}$=6.

10. The method of claim 1, wherein the wheels of the vehicle are arranged on axles, wherein the method further comprises:

calculating axle loads from the support forces ($F_i$) of the wheels; and monitoring the axle loads.

11. The method of claim 6, further comprising:

detecting the support forces ($F_i$) provided by the wheels by measurement of spring relief travel.

12. The method of claim 1, wherein lengths ($L_i$) of vibration dampers of the wheels are detected and a length-stability coefficient ($S_L$) is monitored, the length-stability coefficient ($S_L$) being calculated from the detected lengths ($L_i$).

13. The method of claim 12, wherein the length-stability coefficient ($S_L$) is calculated in accordance with the following formula:

$$S_L = \frac{\sum_{i=1}^{r_{total}} L_{rem,i}}{\sum_{i=1}^{r_{min}-1} L_{rem,i,max}},$$

with $L_{rem,i}=L_{limit,i}-L_i$, wherein ($r_{total}$) specifies a total number of the wheels, ($r_{min}$) specifies a predetermined minimum number of wheels by which the vehicle must be supported, ($L_{rem,i}$) specifies remaining lengths of the vibration dampers until the wheels lift off, ($L_{limit,i}$) specifies limit lengths of the vibration dampers at which the wheels lift off the ground, and ($L_{rem,i,max}$) specifies the ($r_{min}-1$) greatest remaining lengths of the vibration dampers.

14. The method of claim 7, further comprising:

operating the loading crane; and observing a condition $S_F>1$ and/or a condition $S_L>1$ during crane operation.

15. The method of claim 1, further comprising:

operating the loading crane; and calculating tipping lines ($K_j$) of the vehicle during crane operation.

16. The method of claim 15, further comprising calculating distances ($l_{i,Kj}$) of the wheels and the support elements relative to the tipping lines ($K_j$).

17. The method of claim 16, wherein the rotational angle of the loading crane about a vertical axis is detected and the support forces ($F_i$) provided by the wheels and the support elements are detected, wherein a remaining stability moment ($M_{rem,K\alpha}$) is monitored in dependence on the rotational angle of the loading crane in relation to a current tipping line ($K_\alpha$) as the stability parameter, and wherein the remaining stability moment ($M_{rem,K\alpha}$) is calculated in accordance with the following formula:

$$M_{rem,K\alpha} = \sum_{i=1}^{a_{total}} F_i \cdot l_{iK\alpha},$$

wherein ($a_{total}$) specifies the total number of wheels and support elements.

18. A device for monitoring a stability parameter of a loading crane mounted on a vehicle, wherein during crane operation the vehicle is supported on the ground by one or more wheels and by one or more support elements separate from the wheels, and wherein there is a predetermined minimum number of wheels and support elements by which the vehicle must be supported, the device comprising:

wheel and support element measuring devices configured to detect contributions of the wheels and also contributions of the support elements to the magnitude of the stability parameter; and a control and regulating unit, to which measured signals of the wheel and support element measuring devices are sent, wherein the control and regulating unit calculates a magnitude of the stability parameter and compares the magnitude of the stability parameter to at least one predetermined limit value.

19. The device of claim 18, wherein the control and regulating unit is configured to generate a warning signal and/or control at least one measure for returning to compliance of the at least one predetermined limit value when the magnitude exceeds or falls below the at least one predetermined limit value.

20. The device of claim 18, wherein the device has a rotational angle measuring device for detecting a rotational angle of the loading crane about a vertical axis and/or an extension condition measuring device for detecting an extension condition of the support elements, and wherein measured signals of the rotational angle and/or extension condition measuring device are sent to the control and regulating unit.

21. The device of claim 18, wherein the support elements are arranged on at least one laterally extendable support extension and the loading crane rests on a crane base connected to the at least one support extension, wherein the support element measuring devices are arranged in the support elements and/or at a connection of the support elements to the support extension and/or at a connection of the support extension to the crane base.

22. The device of claim 18, wherein the wheel and support element measuring devices detect the support forces ($F_i$) provided by the wheels and the support elements.

23. The device of claim 22, further comprising springs, wherein the wheel and support element measuring devices detect the support forces ($F_i$) provided by the wheels by a measurement of spring relief travels.

24. The device of claim 18, wherein the wheels include vibration dampers, and wherein the wheel measuring devices detect lengths ($L_i$) of vibration dampers of the wheels.

25. The device of claim 18, wherein the control and regulating unit calculates tipping lines ($K_j$) of the vehicle during the crane operation.

26. The device of claim 25, wherein the control and regulating unit calculates distances ($l_{i,Kj}$) of the wheels and support elements relative to the tipping lines ($K_j$).

27. A vehicle comprising:

a loading crane;

wheels;

extendable support elements; and the device of claim 18.

* * * * *